US009663121B2

(12) United States Patent
Nishimura et al.

(10) Patent No.: US 9,663,121 B2
(45) Date of Patent: May 30, 2017

(54) RAILCAR BOGIE AND RAILCAR INCLUDING SAME

(71) Applicant: KAWASAKI JUKOGYO KABUSHIKI KAISHA, Kobe-shi, Hyogo (JP)

(72) Inventors: Takehiro Nishimura, Kobe (JP); Shunichi Nakao, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 36 days.

(21) Appl. No.: 14/759,756

(22) PCT Filed: Jan. 6, 2014

(86) PCT No.: PCT/JP2014/000004

§ 371 (c)(1),
(2) Date: Jul. 8, 2015

(87) PCT Pub. No.: WO2014/109278

PCT Pub. Date: Jul. 17, 2014

(65) Prior Publication Data

US 2015/0353105 A1 Dec. 10, 2015

(30) Foreign Application Priority Data

Jan. 10, 2013 (JP) ..... 2013-002706

(51) Int. Cl.
*B61F 5/20* (2006.01)
*B61F 5/26* (2006.01)
(Continued)

(52) U.S. Cl.
CPC ..... *B61F 5/26* (2013.01); *B61F 5/302* (2013.01); *B61F 5/305* (2013.01); *B61F 5/52* (2013.01)

(58) Field of Classification Search
CPC ..... B61F 5/26; B61F 5/28; B61F 5/30; B61F 5/302; B61F 5/305; B61F 5/50; B61F 5/52
See application file for complete search history.

(56) References Cited

U.S. PATENT DOCUMENTS 2,098,459 A * 11/1937 McWhirter ..... B61F 3/04 105/167
3,948,188 A * 4/1976 Zehnder ..... B60G 11/04 105/167
(Continued)

FOREIGN PATENT DOCUMENTS

EP 0 547 010 B1 6/1993
EP 2 835 301 A1 2/2015
(Continued)

OTHER PUBLICATIONS

Aug. 25, 2016 Extended Search Report issued in European Patent Application No. 14738012.5.
(Continued)

*Primary Examiner* — Jason C Smith
(74) *Attorney, Agent, or Firm* — Oliff PLC

(57) ABSTRACT

A railcar bogie includes: a cross beam extending in a car width direction and supporting a carbody; plate springs extending in a car longitudinal direction and supporting both respective car-width-direction end portions of the cross beam; axle boxes accommodating respective bearings for axles and supporting respective car longitudinal-direction end portions of the plate springs; plate spring receivers each located between the plate spring and the axle box and including an upper surface which is inclined toward a longitudinal-direction middle portion of the plate spring, the upper surface receiving the plate spring; and stoppers
(Continued)

arranged so as to cover at least a part of an upper surface of the plate spring, the part being located above the axle box.

8 Claims, 4 Drawing Sheets

(51) Int. Cl.
*B61F 5/52* (2006.01)
*B61F 5/30* (2006.01)

(56) References Cited

U.S. PATENT DOCUMENTS 4,175,772 A * 11/1979 Lampert ..... B60G 17/023 267/262
4,332,201 A * 6/1982 Pollard ..... B61F 3/04 105/167
4,363,277 A * 12/1982 Martin ..... B61F 5/22 105/164
4,648,326 A * 3/1987 Jackson ..... B61F 3/04 105/138
4,742,779 A * 5/1988 Bevand ..... B61F 3/04 105/167
5,020,824 A * 6/1991 Mounier-Poulat ..... B60G 5/053 267/266
5,039,071 A * 8/1991 Irle ..... B61F 5/148 105/197.05
5,632,208 A * 5/1997 Weber ..... B61F 3/10 105/182.1
6,119,602 A * 9/2000 Yoshino ..... B61F 5/305 105/167
6,250,232 B1 * 6/2001 Hachmann ..... B61F 5/325 105/157.1
6,338,300 B1 * 1/2002 Landrot ..... B61F 5/305 105/182.1
7,328,660 B2 2/2008 Landrot
7,934,458 B2 * 5/2011 Gedenk ..... B61F 5/307 105/197.05
2005/0116436 A1 * 6/2005 Landrot ..... B61F 5/305 280/124.109
2008/0229968 A1 * 9/2008 Gedenk ..... B61F 5/305 105/198.7
2010/0107923 A1 * 5/2010 Rodet ..... B61F 5/325 105/197.05
2011/0247520 A1 * 10/2011 Liu ..... B61F 3/02 105/197.05
2014/0137765 A1 * 5/2014 Nishimura ..... B61F 5/52 105/182.1
2015/0083019 A1 * 3/2015 Nishimura ..... B61F 5/32 105/197.05
2015/0107487 A1 * 4/2015 Zanutti ..... B61F 5/325 105/172
2015/0158506 A1 * 6/2015 Nishimura ..... B61F 5/52 105/197.05
2015/0251670 A1 * 9/2015 Kamura ..... B61F 5/305 105/197.05
2015/0344046 A1 * 12/2015 Nishimura ..... B61F 5/52 105/199.1
2015/0344047 A1 * 12/2015 Nishimura ..... B61F 5/52 105/197.05
2015/0353105 A1 * 12/2015 Nishimura ..... B61F 5/52 105/199.1
2016/0251023 A1 * 9/2016 Nishimura ..... B61F 5/302

FOREIGN PATENT DOCUMENTS

GB 1446793 A 8/1976
JP S55-47950 A 4/1980
JP H01-68904 U 5/1989
JP H02-114577 U 9/1990
JP H02-234818 A 9/1990
JP H04-119266 U 10/1992
JP 2010-228629 A 10/2010
JP 2010-228630 A 10/2010

OTHER PUBLICATIONS

Oct. 22, 2015 Office Action issued in Taiwanese Patent Application No. 103100790.
Jul. 14, 2015 International Preliminary Report on Patentability issued in International Patent Application PCT/JP2014/000004.
Feb. 25, 2014 International Search Report issued in Application No. PCT/JP2014/000004.
Jun. 28, 2016 Office Action issued in Chinese Patent Application No. 201480003791.1.
Jul. 7, 2016 Office Action issued in Singaporean Patent Application No. 11201505318V.

* cited by examiner

RAILCAR BOGIE AND RAILCAR INCLUDING SAME

TECHNICAL FIELD

The present invention relates to a bogie supporting a carbody of a railcar, and particularly to a railcar bogie which prevents a plate spring from falling.

BACKGROUND ART

Typically, a bogie of a railcar is constituted by wheels, axles, and a bogie frame. The bogie frame includes a cross beam and a pair of side sills. The cross beam extends in a railcar width direction. The side sills are joined to both respective ends of the cross beam by welding or the like and extend in a front/rear direction. Axle boxes accommodating respective bearings for supporting the axle are supported by an axle box suspension and are configured to be displaceable in an upper/lower direction relative to the bogie frame. Problems of such a bogie are that the manufacturing cost is high due to a large number of welded portions, and the weight of the bogie is heavy. Here, PTL 1 proposes a bogie from which side sills are omitted.

CITATION LIST

Patent Literature

PTL 1: Japanese Laid-Open Patent Application Publication No. 55-47950

SUMMARY OF INVENTION

Technical Problem

The bogie described in PTL 1 is configured such that: plate springs are used as primary suspensions; front/rear direction middle portions of the plate springs are fixed to both respective railcar width direction end portions of a cross beam; and both front/rear direction end portions of the plate springs are inserted in respective spring receiving portions provided at respective axle boxes. Each of the spring receiving portions described in PTL 1 has a tubular shape, and work of inserting the plate spring into the spring receiving portion is not easy. In addition, the bogie including the plate spring is required to have such a structure that the plate spring hardly falls.

The present invention was made under these circumstances, and an object of the present invention is to provide a railcar bogie including a plate spring, the railcar bogie being configured such that: the plate spring is easily attached to the railcar bogie; and the plate spring hardly falls.

Solution to Problem

A railcar bogie according to one aspect of the present invention includes: a cross beam extending in a car width direction and supporting a carbody; plate springs extending in a car longitudinal direction and supporting both respective car-width-direction end portions of the cross beam; axle boxes accommodating respective bearings for axles and supporting respective car longitudinal-direction end portions of the plate springs; plate spring receivers each located between the plate spring and the axle box and including an upper surface which is inclined toward a longitudinal-direction middle portion of the plate spring, the upper surface receiving the plate spring; and stoppers each arranged in a vicinity of the car longitudinal-direction end portion of the plate spring so as to cover at least a part of an upper surface of the plate spring, the car longitudinal-direction end portion being located above the axle box.

According to the above railcar bogie, the plate springs can be attached only by placing the members on the upper surfaces of the axle boxes in order, and the plate springs can be prevented from falling by the stoppers.

Advantageous Effects of Invention

According to the above configuration, the present invention can provide the railcar bogie configured such that: the plate spring is easily attached to the railcar bogie; and the plate spring hardly falls.

DESCRIPTION OF EMBODIMENTS

Hereinafter, embodiments will be explained in reference to the drawings. In the following explanations and drawings, the same reference signs are used for the same or corresponding components, and a repetition of the same explanation is avoided.

First Embodiment

Figure 1:
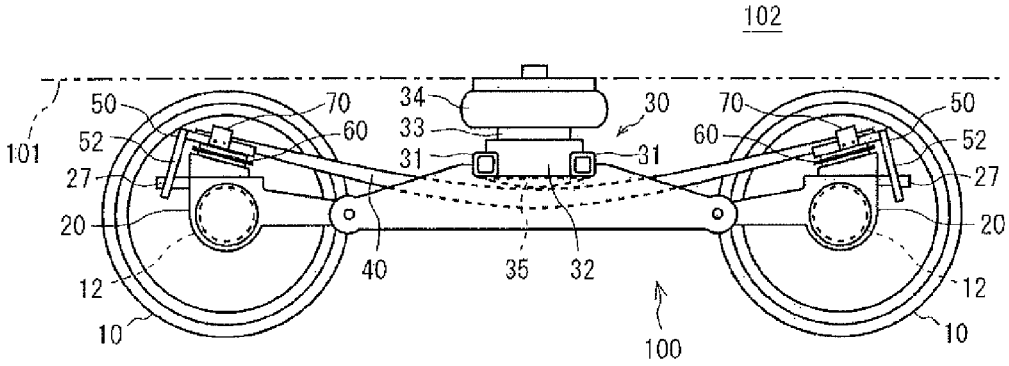
FIG. 1 is a side view of a bogie according to a first embodiment.
Figure 2:
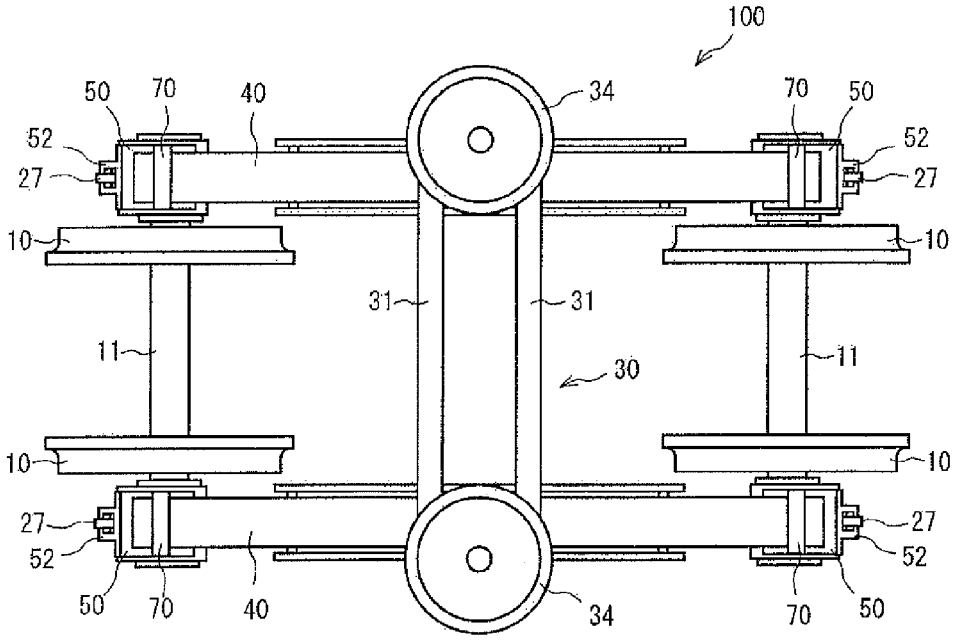
FIG. 2 is a plan view of the bogie shown in FIG. 1.

First, a bogie 100 according to the first embodiment will be explained in reference to FIGS. 1 to 5. FIG. 1 is a side view of the bogie 100. FIG. 2 is a plan view of the bogie 100. A left/right direction on the sheet of FIG. 1 corresponds to a "car longitudinal direction", and a direction perpendicular to the sheet of FIG. 1 corresponds to a "car width direction". As shown in FIGS. 1 and 2, the bogie 100 is used for a railcar 102 and includes wheels 10, axle boxes 20, a cross beam 30, plate springs 40, plate spring receivers 50, gap bodies 60, and stoppers 70.

The wheels 10 are provided at four respective positions of the bogie 100. As shown in FIG. 2, the wheels 10 opposed to each other in the car width direction are coupled to each other by an axle 11. The axles 11 are held by bearings 12 at positions outside the wheels 10 in the car width direction. The bogie 100 according to the present embodiment is a so-called trailing bogie and does not include a driving device. However, in the case of an electric bogie, the axle 11 is connected to an electric motor via a gear box and is driven by this electric motor.

Figure 3:
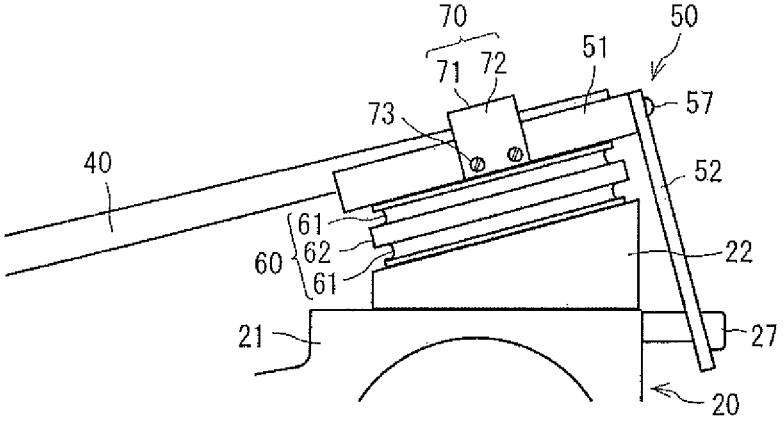
FIG. 3 is an enlarged side view of an upper portion of an axle box of the bogie shown in FIG. 1.
Figure 4:
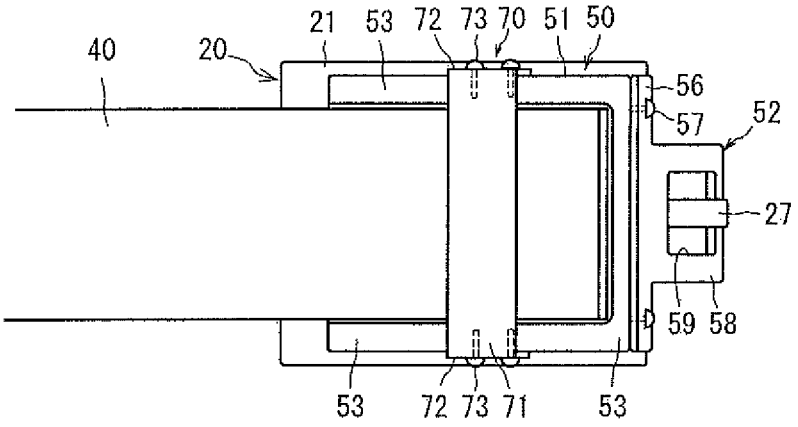
FIG. 4 is a plan view of the portion shown in FIG. 3.
Figure 5:
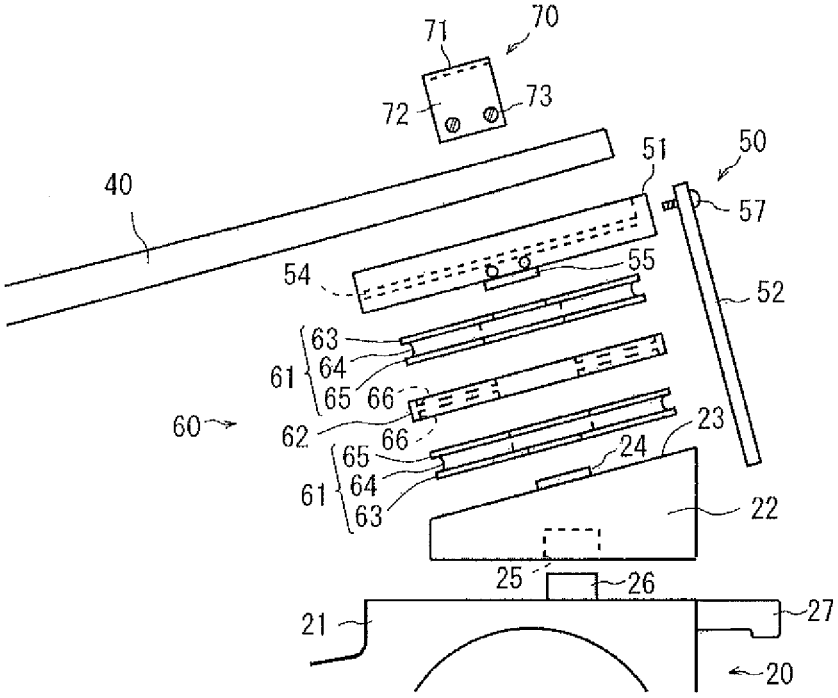
FIG. 5 is an exploded view of the portion shown in FIG. 3.

Each of the axle boxes 20 is a member accommodating the bearing 12 and supporting the plate spring 40 via the plate spring receiver 50 and the gap body 60 described later. FIG. 3 is an enlarged side view of an upper portion of the axle box 20. FIG. 4 is a plan view of the portion shown in FIG. 3. FIG. 5 is an exploded view of the portion shown in FIG. 3. The axle box 20 includes an axle box main body 21 and a spring seat 22 placed on the axle box main body 21. As shown in FIG. 5, a supporting surface 23 that is an upper surface of the spring seat 22 is inclined toward a longitudinal-direction middle portion of the plate spring 40, and a columnar insertion piece 24 is formed at a middle of the supporting surface 23. An insertion hole 25 is formed on a lower surface of the spring seat 22, and an insertion piece 26 is formed on an upper surface of the axle box main body 21.

The axle box 20 includes a locking member 27. The locking member 27 is located at a car-longitudinal-direction outer side of the axle box main body 21 and formed so as to extend toward the car-longitudinal-direction outer side. The locking member 27 is formed so as to penetrate a below-described locking hole 59 (see FIG. 4) formed at a locked member 52 of the plate spring receiver 50. A shape of the locking member 27 is not especially limited. As shown in FIG. 5, in the present embodiment, a lower surface of a portion of the locking member 27 is formed to be concave, the portion being close to the axle box main body 21. Therefore, once the locked member 52 is locked with the locking member 27, the locked member 52 hardly comes off. A position of the locking member 27 is not especially limited. The locking member 27 may be attached to a car-width-direction side surface of the axle box main body 21. To be specific, the locked member 52 is only required to be locked with the locking member 27 when the locked member 52 tries to move upward.

The cross beam 30 is a member supporting a carbody 101. As shown in FIGS. 1 and 2, the cross beam 30 includes a pair of square pipes 31 and connecting members 32. The square pipes 31 extend in the car width direction and are made of metal. The connecting members 32 are located near both respective car width direction ends of the square pipes 31 and connect the square pipes 31 to each other. Upper surfaces of the connecting members 32 hold respective air spring bases 33. Air springs 34 that are secondary suspensions are attached to the respective air spring bases 33. To be specific, the cross beam 30 supports the carbody 101 via the air springs 34 and the air spring bases 33.

Each of the plate springs 40 is a member having both the function of a conventional coil spring (primary suspension) and the function of a conventional side sill. The plate springs 40 extend in the car longitudinal direction. Middle portions of the plate springs 40 support both respective car-width-direction end portions of the cross beam 30 via respective contacting members 35. Both longitudinal-direction end portions of the plate spring 40 are supported by the axle boxes 20 via the plate spring receivers 50 and the like. In a side view, the plate spring 40 has a bow shape that is convex downward. Therefore, force in a direction toward the longitudinal-direction middle portion of the plate spring 40 is being applied to each of both car-longitudinal-direction end portions of the plate spring 40 at all times. A material of the plate spring 40 is not especially limited. For example, a composite material constituted by a lower layer portion made of fiber-reinforced resin and an upper layer portion made of thin metal may be used as the material of the plate spring 40. The longitudinal-direction middle portion of the plate spring 40 is thicker than each of both longitudinal-direction end portions of the plate spring 40.

Each of the plate spring receivers 50 is a member located at a longitudinal-direction end portion of the plate spring 40 and receiving the plate spring 40 on an upper surface of the plate spring receiver 50. As shown in FIG. 3, each of the plate spring receivers 50 includes a plate spring receiver main body 51 and the locked member 52 attached to the plate spring receiver main body 51. As shown in FIG. 4, the plate spring receiver main body 51 has a substantially rectangular shape in a plan view, and protective walls 53 are formed at three respective sides of the plate spring receiver main body 51, the three sides being a car-width-direction inner side, a car-width-direction outer side, and a car-longitudinal-direction outer side. Further, as shown in FIG. 5, a rubber sheet 54 is laid on a portion of the plate spring receiver main body 51, the portion being surrounded by the protective walls 53. The plate spring receiver 50 receives the plate spring 40 via the rubber sheet 54. The upper surface of the plate spring receiver 50 which receives the plate spring 40 is inclined toward the longitudinal-direction middle portion of the plate spring 40. A columnar insertion piece 55 is formed on a lower surface of the plate spring receiver main body 51.

The locked member 52 is a portion locked with the locking member 27 of the axle box 20. As shown in FIG. 4, the locked member 52 of the present embodiment is a plate-shaped member having a substantially T shape. An attaching portion 56 that is an upper portion of the locked member 52 is fixed to a car-longitudinal-direction outer side surface of the plate spring receiver main body 51 by screws 57. An extending portion 58 of the locked member 52 which is located under the attaching portion 56 extends to the axle box 20. The extending portion 58 is provided with the locking hole 59, and the locking member 27 of the axle box 20 is inserted into the locking hole 59. To be specific, the locking member 27 penetrates the locking hole 59. The locked member 52 is not limited to the above-described substantially T shape. For example, the attaching portion 56 may extend to both car-width-direction side surfaces of the plate spring receiver main body 51 and be fixed to these side surfaces. Or, the plate spring receiver main body 51 and the locked member 52 may be formed integrally.

The gap body 60 is a member arranged between the plate spring receiver 50 and the axle box 20. As shown in FIG. 5, the gap body 60 is mainly constituted by: two elastic plates 61; and a rubber seat 62 arranged between these two elastic plates 61. Each of the elastic plates 61 and the rubber seat 62 has an annular shape. The elastic plate 61 at an upper side is formed by stacking a first metal plate 63, a rubber layer 64, and a second metal plate 65 in this order from the upper side. The elastic plate 61 at a lower side is formed by stacking the second metal plate 65, the rubber layer 64, and the first metal plate 63 in this order from the upper side. Annular grooves 66 are formed on both respective surfaces of the rubber seat 62, and the second metal plates 65 are fitted in the respective annular grooves 66.

The stopper 70 is a member which prevents the plate spring 40 from falling. The stopper 70 is arranged in the vicinity of the longitudinal-direction end portion of the plate spring 40 so as to cover at least a part of the upper surface of the plate spring 40, the longitudinal-direction end portion being located above the axle box 20. The stopper 70 of the present embodiment includes an upper surface portion 71 and side surface portions 72. The upper surface portion 71 is located above the plate spring 40. The side surface portions 72 are located at both respective car-width-direction ends of the upper surface portion 71 and fixed to the side surfaces of the plate spring receiver 50. Specifically, each of the side surface portions 72 is fixed to the car-width-direction side surface of the plate spring receiver 50 by screws 73. In the present embodiment, the upper surface portion 71 is configured to cover the plate spring 40 entirely in the car width direction. However, the upper surface portion 71 may be configured to cover the plate spring 40 partially in the car width direction. For example, the stopper 70 may be formed in an L shape, and such stoppers 70 may be fixed to both respective car-width-direction side surfaces of the plate spring receiver 50. The stopper 70 may not be configured to be detachable from the plate spring receiver 50, but the stopper 70 and the plate spring receiver 50 may be formed integrally.

Next, a method of attaching the plate spring 40 will be explained in reference to FIG. 5. First, the insertion piece 26 of the axle box main body 21 is inserted into the insertion hole 25 of the spring seat 22. Thus, the spring seat 22 is attached to the upper surface of the axle box main body 21. Next, the insertion piece 24 of the spring seat 22 is inserted into an inner peripheral portion of the first metal plate 63 of the elastic plate 61 located at the lower side. Then, the rubber seat 62 is stacked on the upper surface of the elastic plate 61 located at the lower side, and the other elastic plate 61 is stacked on the rubber seat 62. With this, the gap body 60 can be attached to the upper surface of the spring seat 22. Next, the insertion piece 55 of the plate spring receiver main body 51 is inserted into an inner peripheral portion of the first metal plate 63 of the elastic plate 61 located at the upper side. Thus, the plate spring receiver main body 51 is attached to the upper surface of the gap body 60. Next, the plate spring 40 is placed on the upper surface of the plate spring receiver main body 51. Next, the locked member 52 and the stopper 70 are fixed to the plate spring receiver main body 51. Thus, the work of attaching the plate spring 40 is completed. As above, according to the present embodiment, the plate spring 40 can be attached only by stacking these members in order. Therefore, the work of attaching the plate spring 40 is extremely easy.

As described above, the plate spring 40 has a bow shape. Therefore, the plate spring 40 is stable in a state where the force toward the longitudinal-direction middle portion is being applied to each of both longitudinal-direction end portions. Therefore, both longitudinal-direction end portions of the plate spring 40 are hardly displaced in the direction toward the longitudinal-direction middle portion. On this account, since the upper surface of the plate spring receiver 50 is inclined toward the longitudinal-direction middle portion of the plate spring 40 along the shape of the plate spring 40, the plate spring 40 is hardly displaced on the upper surface of the plate spring receiver 50. Thus, according to the present embodiment, although the plate spring 40 is attached just by stacking the members, the plate spring 40 does not fall in a normal operation state.

However, if an impact much higher than an impact at the time of the normal operation is applied to the plate spring 40 when, for example, the railcar 102 derails, the plate spring 40 may float up. If the plate spring 40 floats up, the plate spring 40 is caught by the stopper 70, and the plate spring receiver 50 tries to float up. However, the locked member 52 of the plate spring receiver 50 is locked with the locking member 27 of the axle box 20. Thus, the plate spring receiver 50 is prevented from floating up. As a result, the upward movement of the plate spring 40 relative to the axle box 20 is restricted. Thus, the plate spring 40 can be prevented from falling from the plate spring receiver 50, and the plate spring receiver 50 can be prevented from falling from the axle box 20.

Second Embodiment

Figure 6:
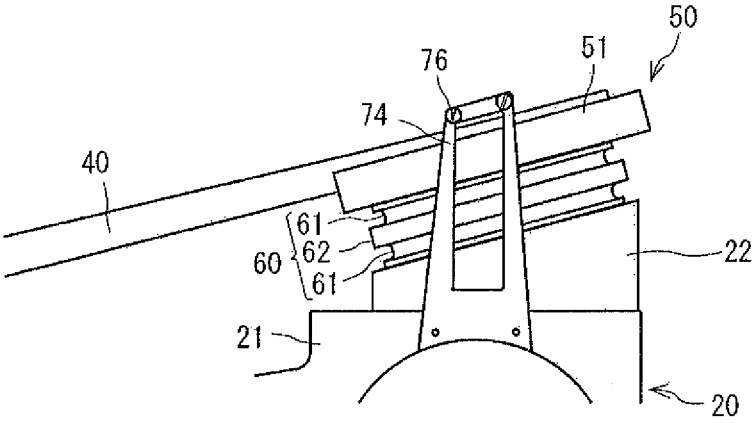
FIG. 6 is an enlarged side view of the upper portion of the axle box of the bogie according to a second embodiment.
Figure 7:
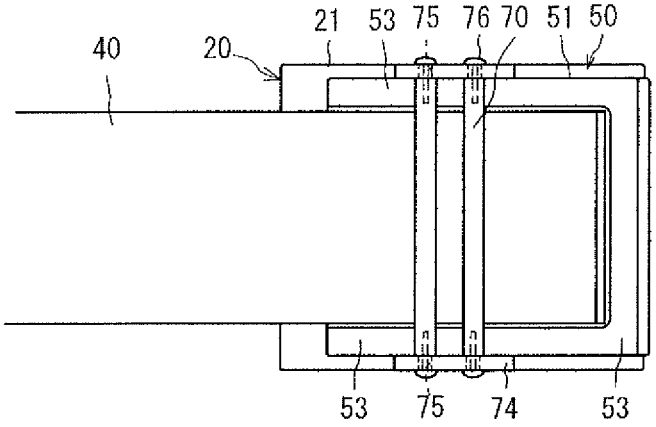
FIG. 7 is a plan view of the portion shown in FIG. 6.

Next, a bogie 200 according to the second embodiment will be explained in reference to FIGS. 6 and 7. FIG. 6 is an enlarged side view showing an upper portion of the axle box 20 of the bogie 200 according to the present embodiment. FIG. 7 is a plan view of the portion shown in FIG. 6. As shown in FIGS. 6 and 7, the bogie 100 according to the first embodiment and the bogie 200 according to the present embodiment are different from each other in that: in the first embodiment, the stopper 70 is fixed to the plate spring receiver 50; and in the present embodiment, two stoppers 70 are held by stopper holding members 74. In the bogie 200 according to the present embodiment, the axle box 20 does not include the locking member 27, and the plate spring receiver 50 does not include the locked member 52.

The stopper holding members 74 are located at both respective car-width-direction sides of the plate spring 40. Lower end portions of the stopper holding members 74 are fixed to the axle box 20. As shown in FIG. 7, holding holes 75 are formed at two positions of an upper end portion of each stopper holding member 74. Each of the stoppers 70 is a round rod made of metal and extends between the stopper holding members 74 in the car width direction. Internal screws are formed at end portions of the stopper 70. The stoppers 70 are arranged so as to correspond to the holding holes 75 of the stopper holding members 74. Each of screws 76 is screwed into the internal screw of the stopper 70 from the car width direction outer side of the stopper holding member 74 through the holding hole 75. With this, the stopper 70 is fixed to the stopper holding member 74. To be specific, the stoppers 70 are held by the stopper holding members 74.

The bogie 200 according to the present embodiment is configured as above. Therefore, as with the first embodiment, the members are stacked, the plate spring 40 is then placed on the plate spring receiver main body 51, and the stoppers 70 are finally attached to the stopper holding members 74. Thus, the work of attaching the plate spring 40 is completed. As above, even in the present embodiment, the plate spring 40 can be attached easily. In the present embodiment, even if the plate spring 40 floats up, the plate spring 40 contacts the stopper 70, so that the upward movement of the plate spring 40 is restricted. Therefore, in the bogie 200 according to the present embodiment, the upward movement of the plate spring 40 and the upward movement of the plate spring receiver 50 are restricted. Thus, the plate spring 40 can be prevented from falling from the plate spring receiver 50, and the plate spring receiver 50 can be prevented from falling from the axle box 20.

As above, each of the bogie according to the first embodiment and the bogie according to the second embodiment includes: a cross beam extending in a car width direction and supporting a carbody; plate springs extending in a car longitudinal direction and supporting both respective car-width-direction end portions of the cross beam; axle boxes accommodating respective bearings for axles and supporting respective car longitudinal-direction end portions of the plate springs; plate spring receivers each located between the plate spring and the axle box and including an upper surface which is inclined toward a longitudinal-direction middle portion of the plate spring, the upper surface receiving the plate spring; and stoppers each arranged in a vicinity of the car longitudinal-direction end portion of the plate spring so as to cover an upper surface of the plate spring, the car longitudinal-direction end portion being located above the axle box. Therefore, as described above, according to the bogie, the plate spring can be easily attached to the bogie, and the plate spring can be prevented from falling.

The bogie according to the first embodiment is configured such that: the stoppers are fixed to the respective plate spring receivers; and upward movements of the plate spring receivers relative to the axle boxes are restricted. Therefore, even if the plate spring receiver floats up by the plate spring contacting the stopper, the upward movement of the plate spring receiver is restricted. As a result, the upward movement of the plate spring itself is restricted. Thus, the plate spring can be prevented from falling.

The bogie according to the first embodiment is configured such that: the axle boxes include respective locking members; the plate spring receivers include respective locked members which are locked with the respective locking members; and the upward movements of the plate spring receivers relative to the axle boxes are restricted. Specifically, each of the locked members extends from a car-longitudinal-direction outer side of the plate spring receiver to the axle box and is provided with a locking hole, and each of the locking members extends toward the car-longitudinal-direction outer side and penetrates the locking hole. Therefore, the upward movement of the plate spring receiver relative to the axle box can be restricted by the simple configuration.

The bogie according to the second embodiment further includes stopper holding members located at both car-width-direction sides of the plate springs and fixed to the axle boxes, wherein: the stoppers extend in the car width direction; and both ends of the stoppers are held by the stopper holding members. In this case, the locked member of the plate spring receiver and the locking member of the axle box portion in the first embodiment can be omitted.

The foregoing has explained the embodiments of the present invention in reference to the drawings. However, specific configurations are not limited to these embodiments. Design changes and the like within the scope of the present invention are included in the present invention.

INDUSTRIAL APPLICABILITY

The present invention can provide a railcar bogie configured such that: a plate spring is easily attached to the railcar bogie; and the plate spring hardly falls. Therefore, the present invention is useful in a technical field of railcars.

REFERENCE SIGNS LIST

11 axle
12 bearing
20 axle box
27 locking member
30 cross beam
40 plate spring
50 plate spring receiver
52 locked member
59 locking hole
70 stopper
74 stopper holding member
100, 200 bogie
101 carbody
102 railcar

The invention claimed is:

1. A railcar bogie comprising:

a cross beam extending in a car width direction and supporting a carbody;

plate springs extending in a car longitudinal direction and supporting both respective car-width-direction end portions of the cross beam;

axle boxes accommodating respective bearings for axles and supporting respective car longitudinal-direction end portions of the plate springs;

plate spring receivers each located between the plate spring and the axle box and including an upper surface which is inclined toward a longitudinal-direction middle portion of the plate spring, the upper surface receiving the plate spring; and stoppers each arranged in a vicinity of the car longitudinal-direction end portion of the plate spring so as to cover at least a part of an upper surface of the plate spring, the car longitudinal-direction end portion being located above the axle box, wherein each stopper has an upper surface portion located above a respective plate spring in a spaced relation such that a gap is formed between the upper surface portion and the plate spring allowing for the plate spring to float upward from the plate spring receiver toward the upper surface portion.

2. The railcar bogie according to claim 1, wherein:

the stoppers are fixed to the respective plate spring receivers; and upward movements of the plate spring receivers relative to the axle boxes are restricted.

3. The railcar bogie according to claim 2, wherein:

the axle boxes include respective locking members;

the plate spring receivers include respective locked members, the locked members being locked with the respective locking members; and the upward movements of the plate spring receivers relative to the axle boxes are restricted.

4. The railcar bogie according to claim 3, wherein:

each of the locked members extends from a car-longitudinal-direction outer side of the plate spring receiver to the axle box and has a locking hole; and each of the locking members extends toward the car-longitudinal-direction outer side and penetrates the locking hole.

5. The railcar bogie according to claim 1, further comprising stopper holding members located at both car-width-direction sides of the plate springs and fixed to the axle boxes, wherein:

the stoppers extend in the car width direction; and both ends of the stoppers are held by the stopper holding members.

6. A railcar comprising the railcar bogie according to claim 1.

7. The railcar bogie according to claim 1, wherein:

the stopper is open on both sides in the car longitudinal direction such that the plate spring is disposed extending through both sides of the stopper in the car longitudinal direction.

8. The railcar bogie according to claim 1, wherein:

the plate springs are received by the plate spring receivers without being fixed to the plate spring receivers.

* * * * *